US006585545B1

(12) United States Patent
Neisen

(10) Patent No.: US 6,585,545 B1
(45) Date of Patent: Jul. 1, 2003

(54) SHIELDED TILT-TRIM SUBSYSTEM FOR BOATS USING A STERN DRIVE SYSTEM

(75) Inventor: Gerald F. Neisen, Oshkosh, WI (US)

(73) Assignee: Bombardier Motor Corperation of America, Grant, FL (US)

( * ) Notice: Subject to any disclaimer, the term of this patent is extended or adjusted under 35 U.S.C. 154(b) by 0 days.

(21) Appl. No.: 10/063,691

(22) Filed: May 8, 2002

Related U.S. Application Data

(60) Provisional application No. 60/319,110, filed on Feb. 6, 2002.

(51) Int. Cl.[7] ..... B63H 20/10

(52) U.S. Cl. ..... 440/57; 440/61 T; 440/76; 440/77

(58) Field of Search ..... 440/61, 57, 53, 440/76, 77, 61 R, 61 T

(56) References Cited

U.S. PATENT DOCUMENTS 3,136,287 A * 6/1964 North ..... 248/640
3,583,357 A * 6/1971 Shimanckas ..... 440/111
4,909,767 A * 3/1990 Hayasaka ..... 440/57
5,215,485 A * 6/1993 Bonner et al. ..... 440/77
5,238,433 A * 8/1993 Hayasaka ..... 440/57

* cited by examiner

*Primary Examiner*—Sherman Basinger
(74) *Attorney, Agent, or Firm*—Ziolkowski Patent Solutions Group, LLC

(57) ABSTRACT

A stern drive system having an outdrive generally disposed downstream relative to water flow aft a transom of the boat is configured to be rotated about a generally horizontal axis to impart a desired trim or tilt to the drive system. A tilt-trim subsystem assembly is affixed to the outdrive and has one respective end thereof configured to pivotally receive an anchor pin supported by the outdrive. The assembly includes at least one cylinder having one end thereof connected to another anchor pin so that when the cylinder is actuated by a circuit therein the outdrive and the tilt subsystem assembly are rotated about the generally horizontal axis during tilt maneuvers. A housing is provided to shield the tilt assembly and configured within the footprint of the outdrive to avoid resistance to water flow. Additionally, the housing may be configured to visually shield the tilt assembly from observers.

32 Claims, 7 Drawing Sheets

SHIELDED TILT-TRIM SUBSYSTEM FOR BOATS USING A STERN DRIVE SYSTEM

CROSS REFERENCE TO RELATED APPLICATIONS

The present invention is a non-provisional application and claims the priority of provisional U.S. patent application Ser. No. 60/319,110 filed Feb. 6, 2002 and entitled "Shielded Tilt-Trim Subsystem For Boats Using A Stern Drive System".

BACKGROUND OF INVENTION

The present invention relates generally to a tilt-trim subsystem assembly for marine propulsion devices and, more particularly, to a shielded tilt-trim subsystem assembly for a stern drive propulsion system.

In marine propulsion devices, it is common to have hydraulic cylinder/piston assemblies located externally of the boat for effecting pivotal movement of the propulsion unit relative to its mounting bracket. For example, in marine propulsion devices of the stern drive or inboard/outboard type, it is common to have hydraulic cylinder/piston assemblies connected between the gimbal ring and the propulsion unit to tilt the propulsion unit relative to the gimbal ring. In other types of marine propulsion devices, such as outboard motors, it is known to have hydraulic cylinder/piston assemblies connected between the mounting bracket and the propulsion unit to steer and/or tilt the propulsion unit relative to the mounting bracket.

In many of these marine propulsion devices having hydraulic assemblies located externally of the boat, means are provided for supplying hydraulic fluid to the hydraulic assemblies from a source of fluid inside the boat. The source of fluid may be connected to a hydraulic circuit also located inside the boat that pressurizes and distributes the hydraulic fluid through a manifold interconnecting respective hydraulic lines to the respective hydraulic cylinder assemblies outside the boat. The hydraulic circuit typically includes a pressure pump and an electric motor coupled to drive the pump. This configuration generally presents several issues. One issue is whether to run the hydraulic lines over the transom or through the transom and, if through the transom, how to seal the opening through which the hydraulic lines pass. Another issue is how to protect the portions of the hydraulic lines extending externally of the transom.

For example, the hydraulic lines may be exposed to a relatively harsh external environment, such as ocean salt water, damaging ultra-violet sunrays and other conditions that may promote galvanic corrosion or deterioration of the line material. Any deterioration of the lines may be further aggravated due to the bending that the lines may be subjected to as the propulsion unit is tilted upwardly and downwardly and/or a steered left and right. This may lead to leaks and a relatively short hydraulic line life. Further, these tilt/drive subsystems can often consume valuable room in the interior of the boat and/or require additional holding fixtures. Moreover, additional labor costs are often associated with installing the subsystem on the boat floor or transom.

Known tilt-trim subsystems use an intricate external assembly including separate tilt and trim cylinders to provide the tilt and trim functions to an outboard propulsion unit that may somewhat alleviate some of the above-discussed issues that often develop in outboard units. Unfortunately, these subsystems do not adequately overcome any of the aforementioned issues as may be encountered in boats using a stern drive propulsion system.

Therefore, it is desirable to design a tilt-trim subsystem assembly that, with a lesser number of components, provides tilt and trim to a stern drive propulsion system that is not subject to the foregoing problems and that can be easily installed either as a replacement kit or as part of an original installation. The increased reliability of the tilt-trim subsystem of the present invention and its ease of service are likely to result in enhanced durability at a lower cost.

BRIEF DESCRIPTION OF INVENTION

Generally speaking, the present invention fulfills the foregoing needs by providing a stern drive system having an outdrive generally disposed downstream relative to water flow aft a transom of the boat. The outdrive is configured to be rotated about a generally horizontal axis to impart a desired trim or tilt to the drive system. A gimbal unit has means for pivotally receiving a first anchor pin. A tilt-trim subsystem assembly is affixed to the outdrive. The tilt-trim assembly has one respective end thereof configured to pivotally receive a second anchor pin supported by the outdrive. The assembly includes at least one cylinder having one end thereof connected to the first anchor pin such that when the cylinder is actuated by a hydraulic or electromechanical circuit therein the outdrive and the tilt-trim subsystem assembly are rotated about the generally horizontal axis during tilt-trim maneuvers. A housing is configured to shield the tilt-trim assembly. In one aspect thereof, the outdrive may be configured within the footprint of the housing to avoid resistance to water flow. In another aspect thereof, the housing is configured to conceal the tilt-trim assembly.

The present invention further fulfills the foregoing needs by providing a tilt-trim subsystem assembly affixed to an outdrive of a stern drive that may be supported by a gimbal unit and may be configured to rotate about a predetermined axis to impart a desired trim or tilt to the drive system. The tilt-trim assembly has one respective end thereof configured to pivotally receive one anchor pin supported by the outdrive. The assembly includes one or more cylinders having one end thereof pivotally connected to another anchor pin so that when the cylinder is actuated, the outdrive and the tilt-trim subsystem assembly are jointly rotated about the predetermined axis. The assembly further includes a hydraulic circuit for actuating the at least one cylinder therein. The tilt-trim assembly is mounted to a base for receiving a housing. The base is scalingly connected to a flange extending at the lower end of the housing to prevent entry of moisture therethrough.

BRIEF DESCRIPTION OF DRAWINGS

The drawings illustrate one preferred embodiment presently contemplated for carrying out the invention.

In the drawings.

DETAILED DESCRIPTION

Figure 1:
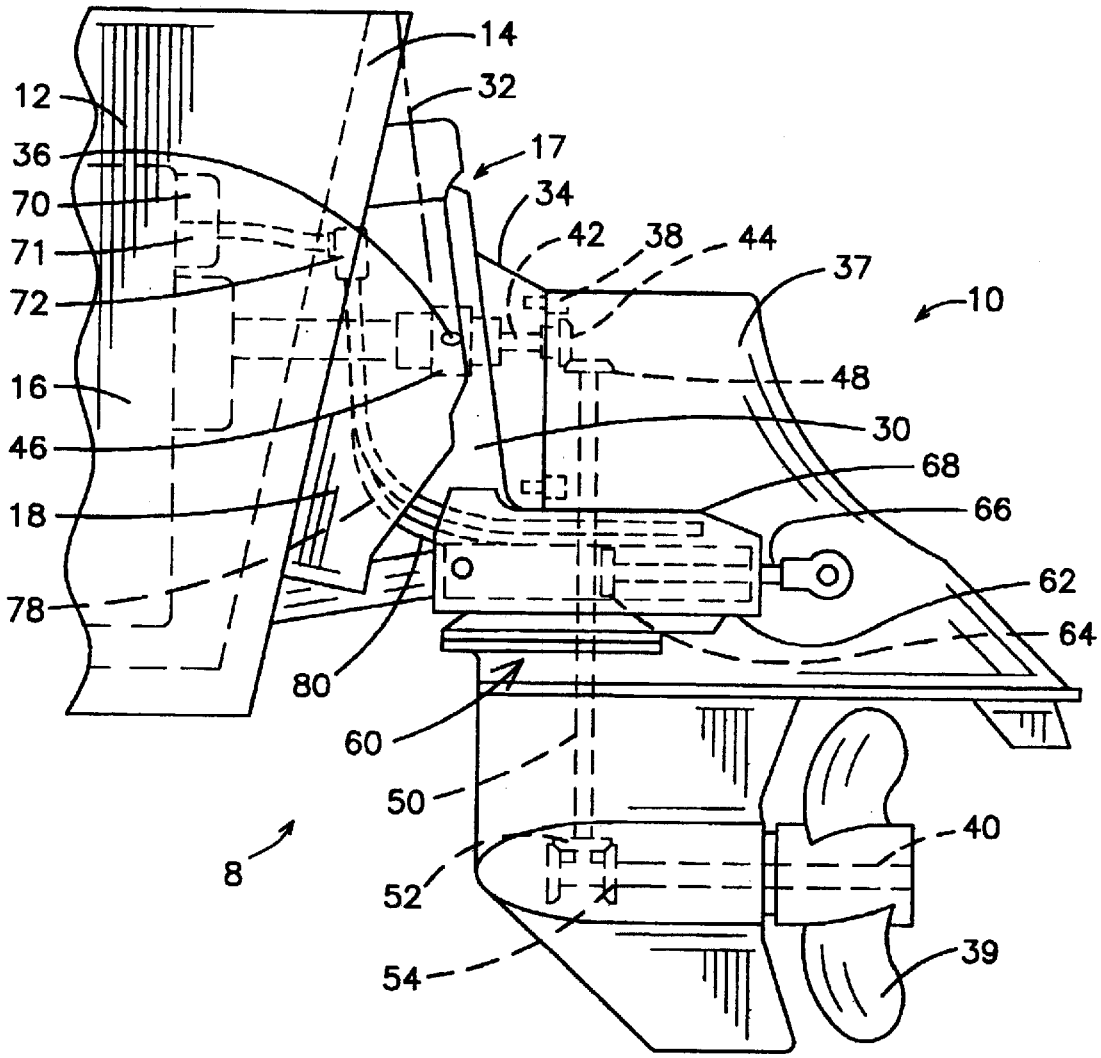
FIG. 1 PRIOR ART
FIG. 1 is a side elevational view of a prior art stern drive system.

FIG. 1 illustrates an exemplary prior art marine propulsion device 8 mounted on a boat 12 having a transom 14 in which a stern drive unit 10 extends rearward therefrom. The marine propulsion device 8 is commonly referred to as a stern drive or inboard/outboard. The marine propulsion device 8 includes an engine 16 securely mounted to the boat frame by suitable means such as known motor mounts (not shown). The marine propulsion device 8 also includes a gimbal housing assembly 17 to secure the stern drive 10 to the boat transom 14. The gimbal housing assembly 17 includes a gimbal housing 18 fixedly attached to the boat transom 14 by any suitable means, such as by bolts extending through the transom 14 into the gimbal housing 18 or vice versa.

The gimbal housing assembly 17 also includes a gimbal ring 30, connected to the gimbal housing 18 for pivotal movement of the stern drive unit 10 relative to the gimbal housing 18 about a generally vertical steering axis 32. A pivot housing 34 is connected to the gimbal ring 30 for pivotal movement about a generally horizontal tilt-trim axis 36. Such a construction is well known in the art and will not be described in detail other than as necessary for an understanding of the invention.

The marine propulsion device 8 has an outdrive 37 that may be removably connected to the pivot housing 34 for common pivotal movement of the outdrive 37 with the pivot housing 34. In the illustrated construction, the outdrive 37 is removably connected to the pivot housing 34 by a plurality of bolts 38. The outdrive 37 includes a generally horizontal drive shaft 42 having one end removably connected to the engine 16 and an opposite end having thereon a bevel gear 44. A universal joint 46 is attached to the horizontal drive shaft 42 to allow pivotal movement of the drive shaft 42 with the stern drive 10. The bevel gear 44 drives a corresponding bevel gear 48 on the upper end of a vertical drive shaft 50. The lower end of the vertical drive shaft 50 has thereon a driving gear 52. A reversible transmission selectively clutches a pair of driven gears 54 to drive propeller shaft 40 and transmit forward or reverse motion to propeller 39.

The marine propulsion device 8 also has a pair of hydraulic cylinder/piston assemblies 60 pivotally connected generally between the gimbal housing assembly 17 and the outdrive 37 for effecting pivotal movement (tilt and trim movement) of the outdrive 37 relative to the gimbal housing 18 about the tilt axis 36. The hydraulic cylinder/piston assemblies 60 are connected between the lower end of the gimbal housing assembly 30 and the outdrive 37. The cylinder/piston assemblies 60 extend on opposite sides of the stern drive 10. The cylinder/piston assembly 60 includes two cylinders 62 having an upper portion, a forward end pivotally connected to the gimbal ring 30, and a rearward end. Each cylinder 62 also include a piston 64 slidably received in the cylinder 62 for reciprocal movement therein, the piston 64 dividing the cylinder 62 into forward and rearward pressure chambers. The cylinder/piston assemblies 60 also include a piston rod 66 having a forward or inner end fixedly attached to the piston 64 and extending outwardly of the rearward end of the cylinder 62, and a rearward or outer end pivotally attached to the stern drive 10. Increasing the pressure in the forward pressure chamber of the cylinder 62 causes the piston rod 66 to extend, thereby causing the stern drive 10 to tilt upwardly, and increasing the pressure in the rearward pressure chamber of the cylinder 62 causes the piston rod 66 to retract, thereby causing the stern drive 10 to tilt downwardly.

The marine propulsion device 8 further comprises a conduit having one end communicating with a tank 70 inside the boat 12. Tank 70 supplies and stores working hydraulic fluid that may be pressurized by a hydraulic circuit 71 having a motor pump also inside the boat. The conduit has an opposite end communicating with the hydraulic cylinder/piston assembly 60. The conduit may extend through an opening in the gimbal housing 18 and may be exposed to the environment external to the boat 12 at least between the gimbal housing 18 and the cylinder assembly 60. The conduit further includes a manifold 72, a first fluid line means that allows communication between the manifold 72 and the hydraulic cylinder/piston assembly 60 for supplying hydraulic fluid to the cylinder/piston assembly 60, and a second fluid line means extending through the opening in the gimbal housing 18 and having one end 71 communicating with the source of fluid 70, and an opposite end communicating with the manifold 72.

The first fluid line means includes a first pair of hydraulic lines communicating between the manifold 72 and the first or right cylinder 62. One of the hydraulic lines of the right pair may be connected to the forward end, e.g., the forward pressure chamber, of the right cylinder 62, and the other hydraulic line of the pair may be connected to the rearward end, e.g., the rearward pressure chamber of the right cylinder 62. The first fluid line means also includes a second pair of hydraulic lines 78 and 80 communicating between the manifold 72 and the second or left cylinder 62. One of the hydraulic lines of the left pair is connected to the forward end, e.g., the forward pressure chamber, of the left cylinder 62, and the other hydraulic line 80 of the left pair being connected to the rearward end, e.g., the rearward pressure chamber, of the left cylinder 62.

As will be appreciated by those skilled in the art, although stern drive propulsions systems such as the previously described exemplary prior art system have proven to provide effective propulsion means to boat users, as suggested above and further described below, the present invention further enhances the reliability and ease of maintenance of such type of marine propulsion systems.

Figure 2:
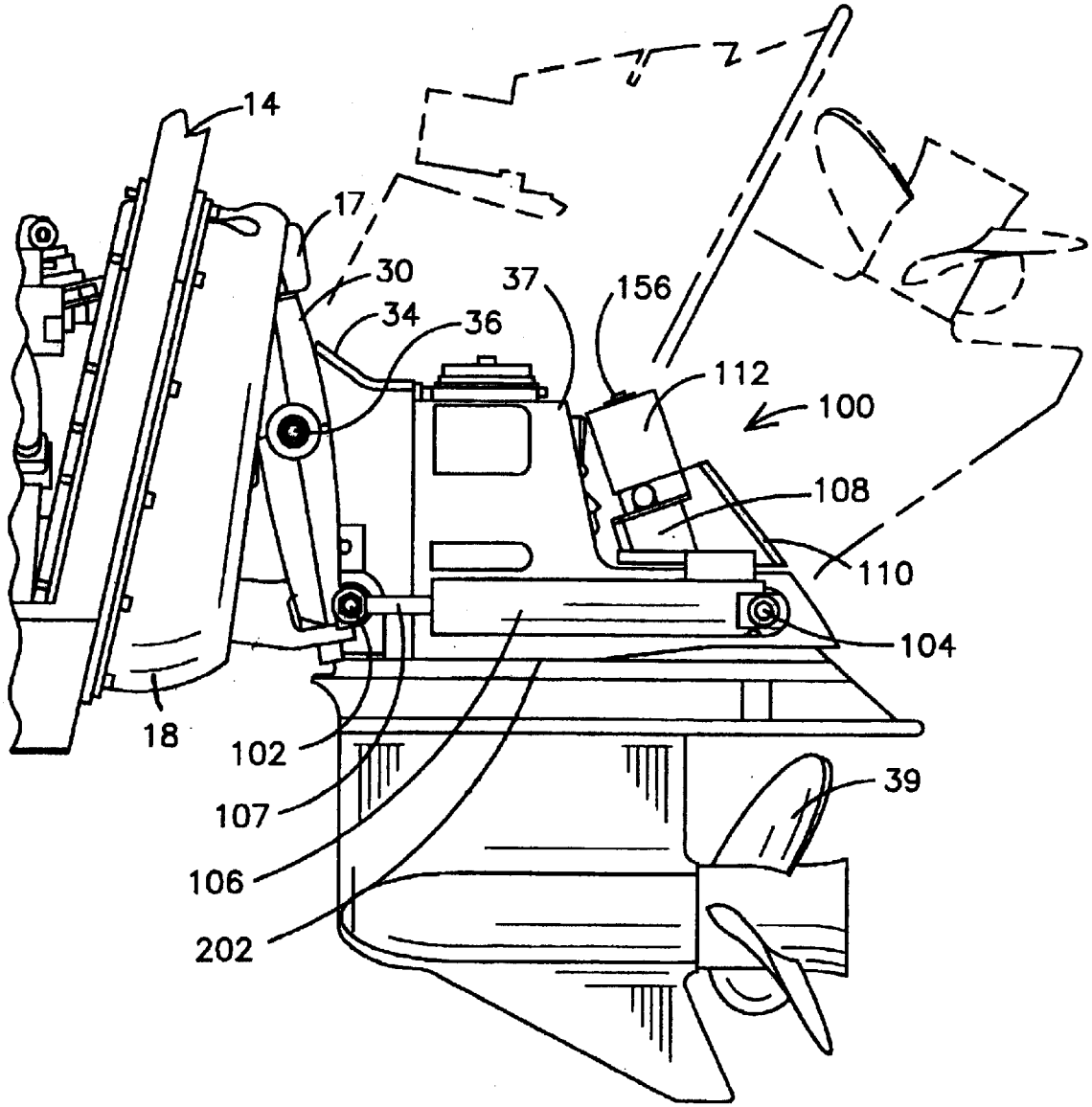
FIG. 2 is a side elevational view of an exemplary embodiment of the present invention showing a tilt-trim subsystem assembly in combination with a stern drive system.
Figure 3:
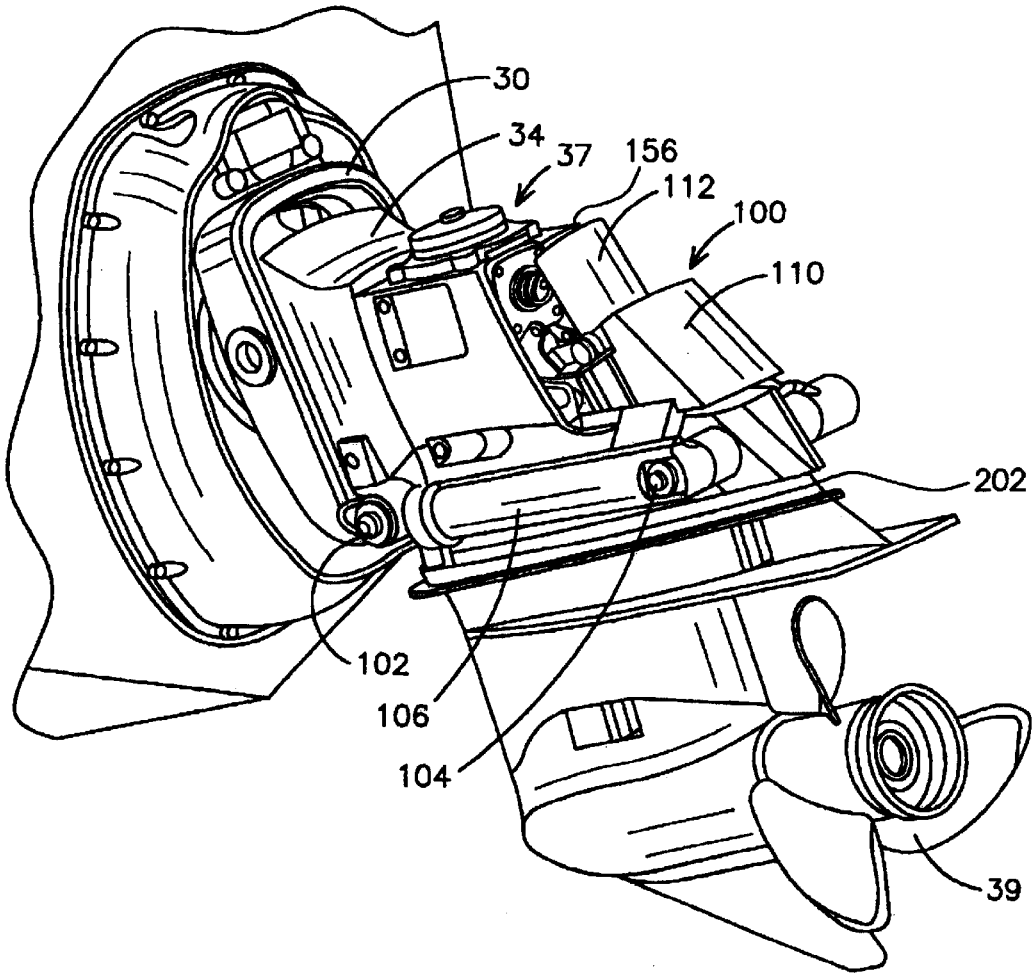
FIG. 3 is a perspective view of the embodiment shown in FIG. 2.
Figure 4:
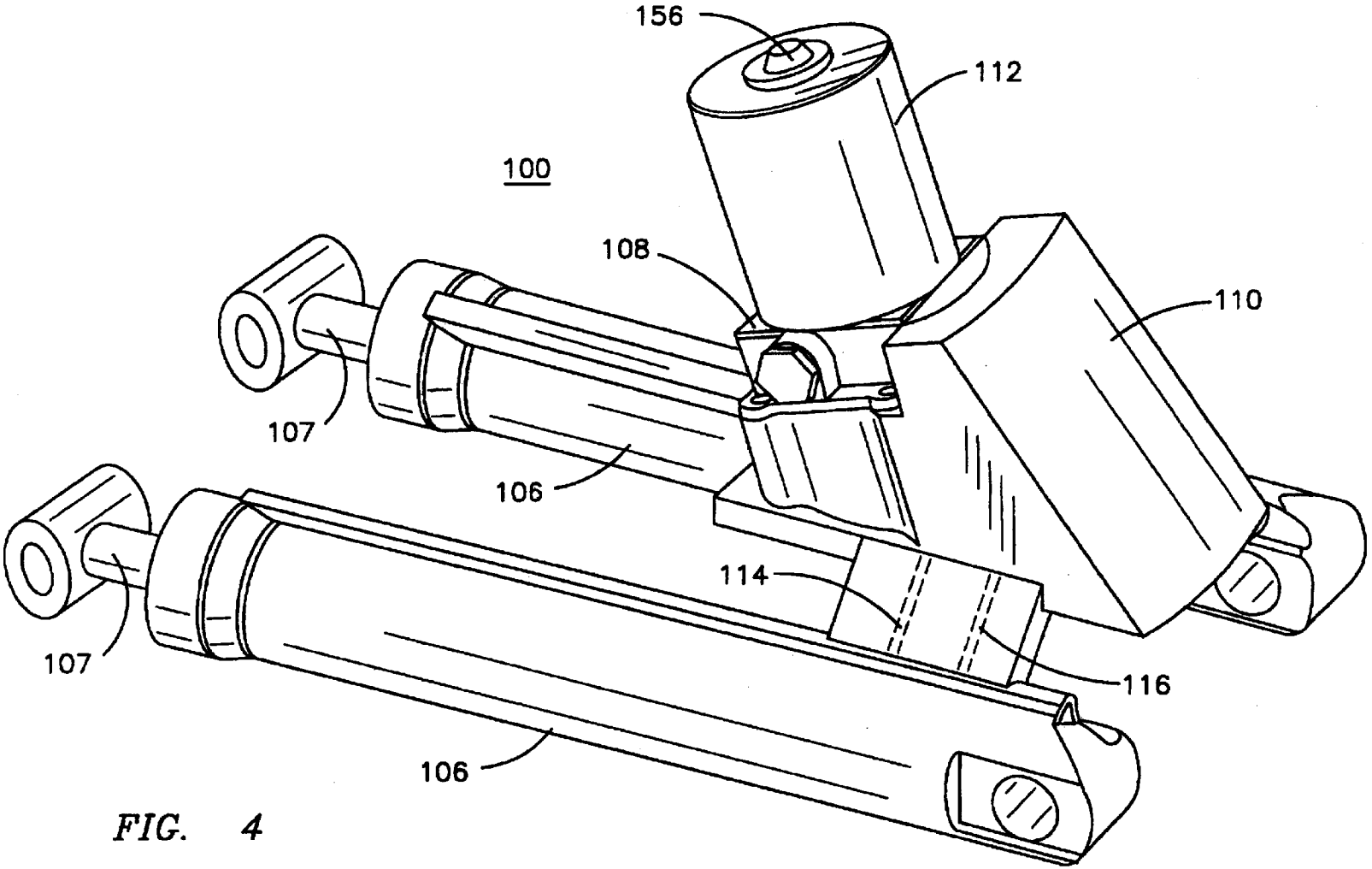
FIG. 4 is a perspective view of the tilt-trim subsystem assembly of the present invention.

FIGS. 2 and 3 illustrate one exemplary embodiment of the present invention showing a tilt-trim subsystem assembly 100 in combination with a stern drive propulsion system. As shown, the tilt/trim subsystem assembly 100 may be affixed to the outdrive 37 using any suitable affixing means, such as pivot pins co-axially disposed relative to tilt-trim axis 36, etc. As further shown, the gimbal housing assembly 17 has means for receiving a first anchor pin 102. The tilt/trim subsystem has one end configured to receive a second anchor pin 104 supported by the outdrive 37. The assembly 100 includes one or more cylinders 106. In the event two cylinders are employed, then one of the cylinders 106 may straddle on one side of outdrive 37, as seen in FIG. 2, and the other of the cylinders 106 may straddle on the other side of the outdrive 37, as best seen in FIG. 4. In the event a single cylinder is used, gimbal ring 30 defines an inner region, and more particularly a lower inner region through which such single cylinder may be centrally disposed.

Centrally arranging the cylinder eliminates any laterally straddling cylinders and could reduce undesirable hydrodynamic drag. Further, such central arrangement of cylinder 106 allows for vertically pivoting outdrive 37 without creating any undesirable torsional moment that could result if the single cylinder was not centrally positioned in the middle of the inner region defined by gimbal ring 30.

Each of the cylinders includes a respective slidable piston 107 that may be pivotally connected at one end thereof to the first anchor pin 102. It will be appreciated that the piston end need not be connected to the first anchor pin 102 since the cylinder/piston could be arranged opposite to the illustrated arrangement so that the piston would be connected to the second anchor pin 104 in lieu of the first anchor pin 102. As better appreciated in FIG. 4, cylinders 106 and the tilt-trim assembly 100 comprise a unitized body, i.e., they comprise one integral unit that may be constructed using well and readily understood casting techniques e.g., die casting, etc. An exemplary material for the assembly may be aluminum or any other relatively lightweight and high strength, and preferably substantially corrosion-resistant material.

Figure 5:
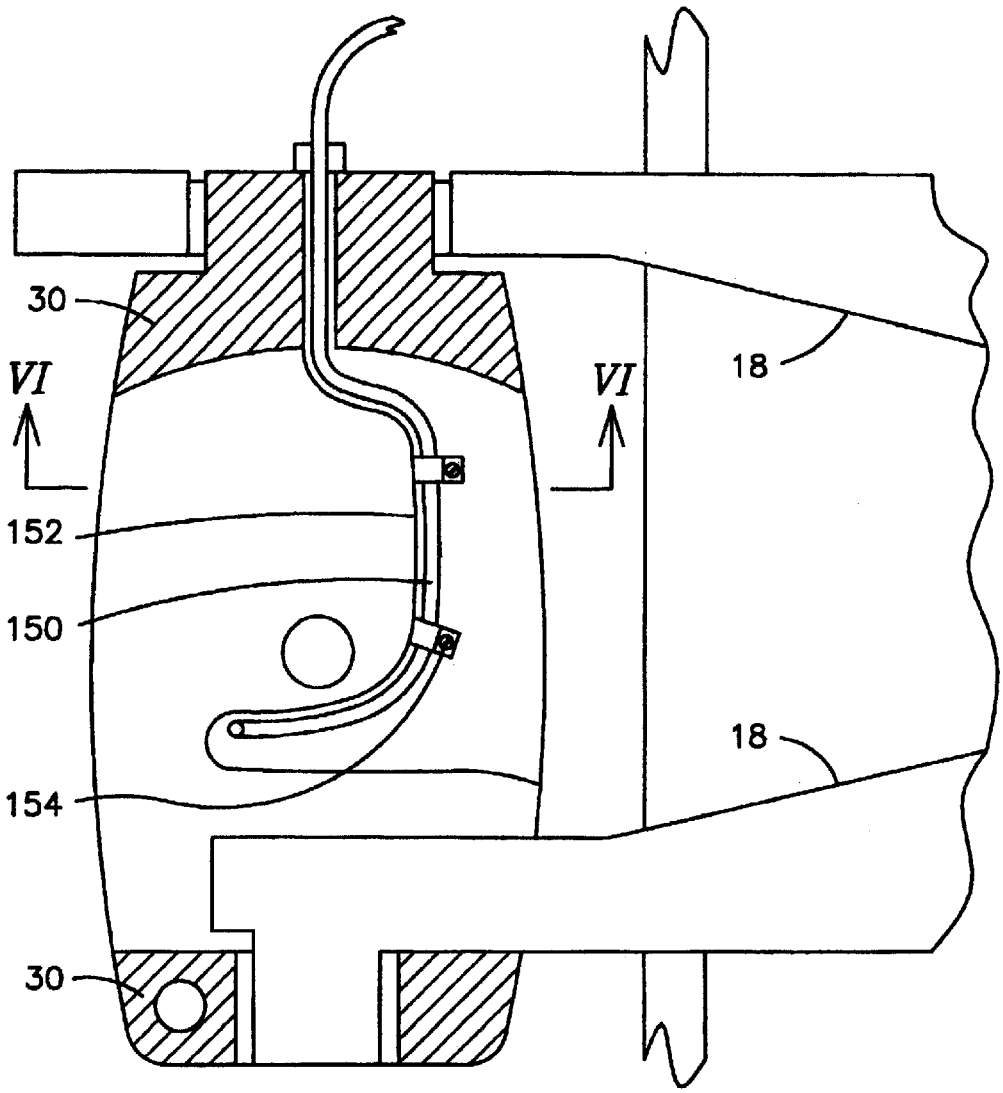
FIG. 5 is a partial cross-sectional view of an exemplary gimbal unit and gimbal housing configured with a recess to accommodate leads that may be used for carrying control and power signals to an electric motor in the tilt-trim assembly.
Figure 6:
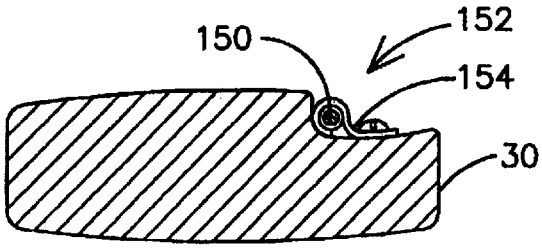
FIG. 6 is cross-sectional view along line VI—VI in FIG. 5 illustrating further details regarding the recess shown in FIG. 5.

As further shown in FIGS. 2 and 3, assembly 100 contains a fluid circuit, e.g., a hydraulic or pneumatic circuit that is completely self-contained within the assembly actuating the cylinders 106 and thus avoiding the various issues generally associated with known tilt/trim subsystems for stern drives. In a preferred embodiment, the hydraulic circuit may be chosen due to its good shock absorbing characteristics. As will be appreciated by those skilled in the art, the hydraulic circuit may be configured using design techniques readily understood by those of ordinary skill in the art. The hydraulic circuit may include a pump 108 and a fluid storage tank 110 connected to pass hydraulic fluid to the pump. The pump 108 may be driven by a motor 112, preferably a reversible DC motor, in response to externally-derived signals supplied to the motor by way of suitable leads 150 as shown in FIGS. 5 and 6. Both the motor and the pump and any associated hydraulic valves, e.g., relief valves, thermal relief valves, manual release valves, etc., may be disposed in respective compartments within the assembly sufficiently sealed to prevent entry of moisture therein.

The tilt/trim assembly 100 may include internal passages 114 and 116, as represented by the dashed lines in FIG. 4, to provide fluid communication between the pump 108, the cylinders 106 and the tank 110. For example, one of the passages may provide a path for supplying pressurized fluid to a pressure chamber of a respective cylinder, and the other passage may provide a return path for fluid returning to the pump and/or storage tank. The passages may be bored using standard drilling techniques or may be configured while the assembly is cast using a mold configured to define such internal passages.

Alternatively, in lieu of providing internal passages, external tubing could be used to provide the supply and return paths to the fluid flowing into or out of the respective cylinders. It will be appreciated that since the assembly 100 rotates together with the outdrive, then in this embodiment, the tubing would not be subject to any bending while the outdrive is being tilted. Similarly, since the length of the tubing is relatively short, and since the hydraulic circuit and the cylinders are contained substantially proximate to one another, then a relatively inexpensive shield can be employed to protect the tubing from the external environment, such as that shown with reference to FIGS. 7 and 8. It will be further appreciated by those skilled in the art, that having shorter hydraulic conduits, either externally or internally located, will result in improved shock transient response from the hydraulic circuit in the event the propulsion unit was to strike an underwater obstruction or object.

FIGS. 5 and 6 illustrate an exemplary construction that may be provided in the gimbal ring 30 to accommodate one or more leads 150 that may carry the externally derived signals to the motor 112 in the tilt/trim assembly 100. As shown in FIGS. 5 and 6, a recess 152, such as a groove or notch, may be configured within the gimbal ring 30 to accommodate leads 150. To secure the leads, affixing means, such as clamps 154, may be used to affix the leads 150 within the gimbal ring 30. The leads 150 need not be uninterruptible since one or more connectors could be used at suitable connecting points to facilitate installation and/or servicing of the tilt/trim assembly 100. A connector or plug 156, as shown in FIG. 2, may be installed onto the trim/tilt assembly 100 near the motor 112 to provide a suitable interconnecting point between any leads disposed within a motor compartment and leads 150. It will be appreciated that any commercially available water-tight connector designed for a marine environment operation will provide a suitable seal to prevent entry of moisture into the tilt-trim assembly 100.

It is noted that tilt-trim devices used for outboard applications are generally disposed adjacent to the transom of the boat and, thus, not subject to downstream water flow as the boat travels in a body of water. Thus, tilt-trim devices for outboard applications are not generally concerned in providing streamlining to avoid resistance to water flow. By way of comparison, the tilt-trim assembly 100 of the present invention is affixed to the outdrive 37 of a stern drive system 10. As will be understood by those of ordinary skill in the art, the outdrive 37 is not necessarily located adjacent relative to the transom 14 of the boat but generally downstream relative to water flow as the boat moves in the body of water. The tilt-trim assembly 100 of the present invention is preferably positioned to be within the footprint of the base 202 of the outdrive 37 to avoid resistance to water flow, that is, within the space circumscribed by the base 202 of the outdrive 37.

Figure 7:
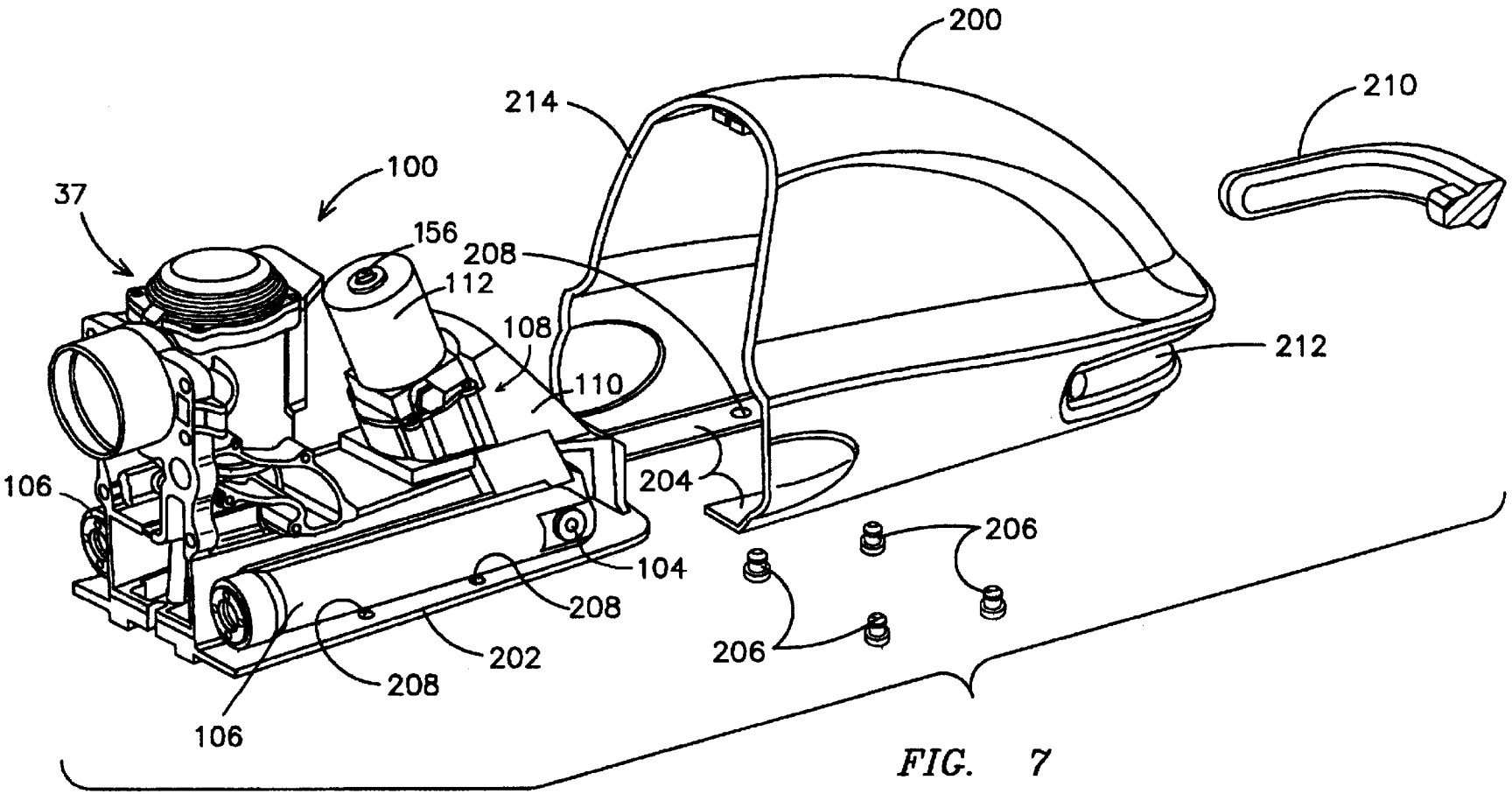
FIG. 7 shows an exploded perspective view illustrating a shielding housing for the tilt-trim subsystem assembly.
Figure 8:
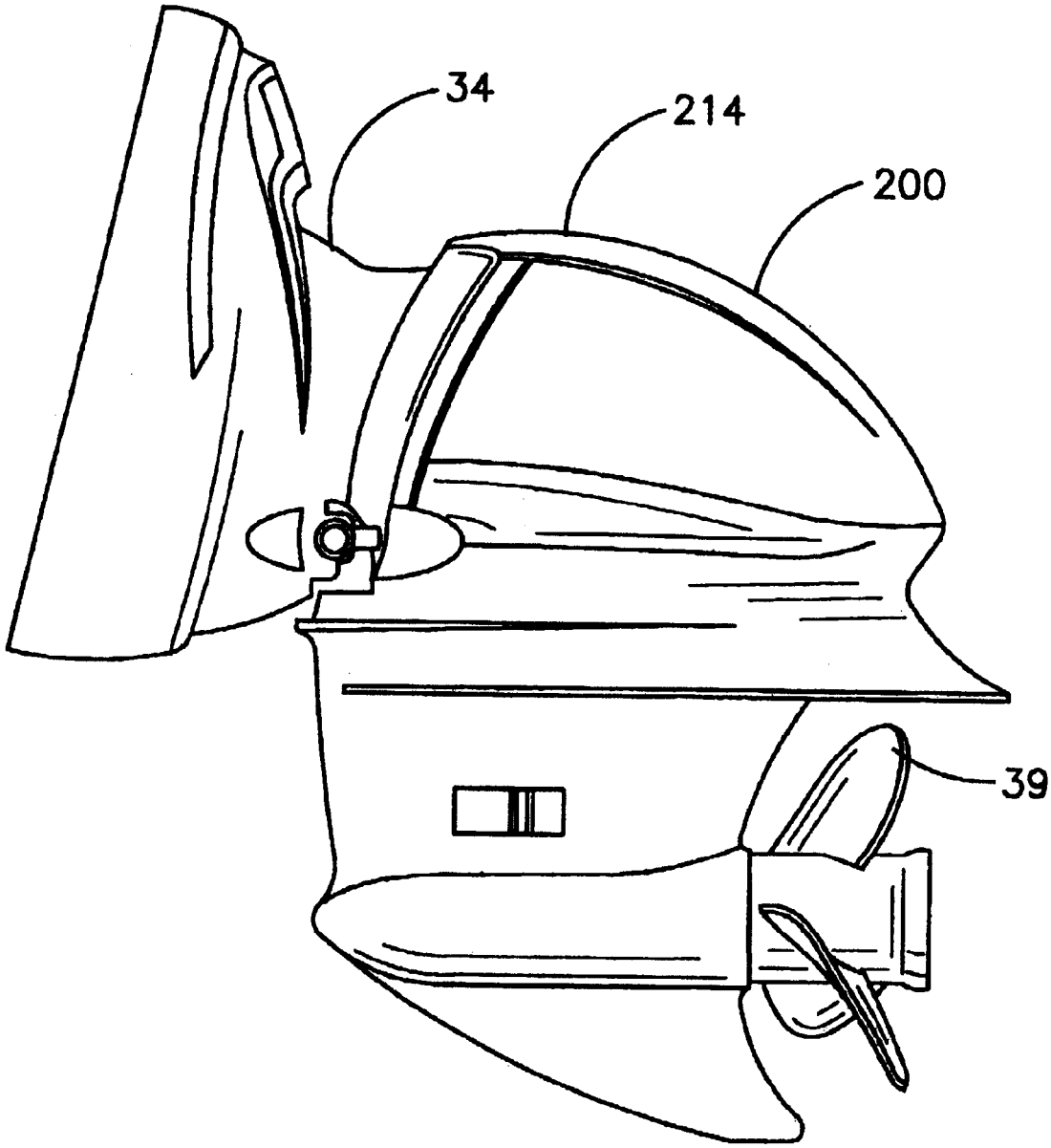
FIG. 8 is a side elevational view of an assembled tilt-trim assembly of FIG. 7 mounted to a stern drive system such as that shown in FIG. 2.

In accordance with one aspect of the present invention, as best shown in FIGS. 7 and 8, a housing 200 is provided to sealingly enclose and shield the tilt-trim subsystem assembly 100 from the environment, e.g., splashing water, rain, dust, etc. Housing 200 may be made of any suitable lightweight and corrosion-resistant material, such as plastic, aluminum or other alloys. As shown in FIG. 7, the outdrive 37 includes a base 202 configured to receive a flange 204 of housing 200 that inwardly extends along the lower end of housing 200. In one exemplary embodiment, a plurality of pliable fasteners 206 are provided for easily affixing housing 200 to base 202 through corresponding openings 208 on base 202 and flange 204 without the use of any tools. As further shown in FIG. 7, a bumper 210, made of a suitable shock absorbing material, such as rubber or hard plastic, may be provided to give protection to the rear end of housing 200. Bumper 210 may be configured to be mounted in a bumper-receiving slot 212 of housing 200. FIG. 8 illustrates housing 200 mounted to fully shield tilt-trim assembly 100.

As shown in FIGS. 7 and 8, the forward section of housing 200 includes an interface edge 214 configured to match a corresponding interface edge of pivot housing 34. It will be appreciated that housing 200 is easily and quickly mountable and removable to provide quick and easy access to the components shielded by such housing during maintenance and servicing operations. It is further believed that housing 200 provides a more aesthetically pleasant appearance since the housing visually shields the various components of the outdrive 37. It will be appreciated, however, that the housing 200 of the present invention is not limited to opaque materials since in some applications a translucent material may be preferable depending on the desires of the boat owner.

Thus, it should now be appreciated that with the present invention, as described above, since the cylinder or cylinders in the tilt/trim assembly comprise a unitized structure and are angularly movable in unison relatively to the gimbal housing, and further since the working hydraulic fluid conduits interconnecting the motor pump, and the tilt/trim cylinder or cylinders therein may now be defined, if so desired, without employing exteriorly installed tubing, then the present invention allows for either avoiding altogether, in the case of internal passageways, or substantially avoiding, in the case of short external tubing, the problem of fluid conduit corrosion, etc. Further, the tilt-trim subsystem may be constructed as a single assembly with the hydraulic pressure circuit incorporated in the assembly. Thus, the tilt-trim subsystem can easily be attached to and detached as a kit from the outdrive and the gimbal housing. As suggested above, the assembly of the present invention may provide increased protection against shocks that may be produced when the propulsion unit is hit by objects, such as driftwood, etc. because of its integrated construction and improved transient response characteristics.

While the preferred embodiments of the present invention have been shown and described herein, it is understood that such embodiments are provided as exemplary only. For example, although some aspects of the present invention have been described in the context of a hydraulic circuit, it will be appreciated that in lieu of using hydraulic cylinders, torque-applying screws rotated by a respective electromechanical actuator could be employed to impart the torque required to tilt or trim the stern drive propulsion system. Thus, numerous variations, changes and substitutions will occur to those of skill in the art without departing from the invention herein.

What is claimed is:

1. An apparatus for protecting components of an outdrive of a stern drive system, the apparatus comprising:

a housing configured to sealingly enclose an outdrive, the housing having a flange extending along a lower end of the housing; and a base having a bottom surface positioned under the outdrive and engageable with a top surface of the flange of the housing.

2. The apparatus of claim 1 further comprising a bumper mounted on a rearward end of the housing.

3. The apparatus of claim 1 further comprising a plurality of pliable fasteners to connect the base to the flange.

4. The apparatus of claim 3 further comprising corresponding openings on the base and the flange to allow ease of installation and removal of the housing without tools.

5. The apparatus of claim 1 wherein the housing is constructed of lightweight and corrosion resistant materials.

6. The apparatus of claim 1 wherein the housing is opaque and visibly shields components of the outdrive.

7. The apparatus of claim 1 wherein the housing is transparent.

8. The apparatus of claim 1 further comprising a bumper receiving slot configured to receive a bumper therein, and wherein the bumper is formed of a shock absorbent material.

9. A tilt-trim subsystem assembly affixed to an outdrive of a stern drive supported by a gimbal unit and configured to rotate about a predetermined axis to impart a desired trim or tilt to the drive system, the tilt-trim assembly having one respective end thereof configured to pivotally receive one anchor pin supported by the outdrive, the assembly including:

at least one cylinder having one end thereof pivotally connected to another anchor pin such that when the at least one cylinder is actuated, the outdrive and the tilt-trim subsystem assembly are jointly rotated about the predetermined axis;

a hydraulic circuit for actuating the at least one cylinder therein;

a housing having a lower end; and a base for receiving the housing, wherein the base is sealingly connected to a flange extending at the lower end of the housing to prevent entry of moisture therethrough.

10. The tilt-trim subsystem assembly of claim 9 further comprising a bumper attached to a rearward end of the housing, and wherein the bumper is formed of a shock absorbing material.

11. The tilt-trim subsystem assembly of claim 10 wherein the housing has one end having a general U-shape to allow the housing to slide over the outdrive and another end that is closed.

12. The tilt-trim subsystem assembly of claim 9 wherein the housing is formed of a lightweight, corrosion resistant material.

13. The tilt-trim subsystem assembly of claim 9 wherein the housing includes a forward section having an interface edge configured to match a corresponding interface of a gimbal housing assembly.

14. The tilt-trim subsystem assembly of claim 9 wherein the housing is configured to be quickly mountable and quickly detachable to provide easy access to components shielded by the housing.

15. The tilt-trim subsystem assembly of claim 9 wherein the housing is configured to visibly shield components of the outdrive from an observer.

16. The tilt-trim subsystem assembly of claim 9 wherein the housing is formed of a translucent material.

17. The tilt-trim subsystem assembly of claim 9 incorporated into a stern drive system mounted on a boat.

18. A stern drive system having an outdrive generally disposed downstream relative to water flow aft a transom of a boat, the outdrive configured to be rotated about a generally horizontal axis to impart a desired trim or tilt to the drive system comprising:

a gimbal unit configured to pivotally receive a first anchor pin;

a tilt-trim assembly affixed to the outdrive, the tilt-trim assembly having one respective end thereof configured to pivotally receive a second anchor pin supported by the outdrive, the assembly including at least one cylinder having one end thereof connected to the first anchor pin so that when the at least one cylinder is actuated, the outdrive and the tilt-trim assembly are rotated about the generally horizontal axis, the assembly further including a circuit coupled to actuate the at least one cylinder therein; and a housing configured to shield the tilt-trim assembly, the outdrive configured within a footprint of the housing to avoid resistance to water flow.

19. The stern drive system of claim 18 wherein the housing includes a flange extending inwardly along a lower end of the housing.

20. The stern drive system of claim 19 wherein the tilt-trim assembly has a base attached to a lower end of the tilt-trim assembly configured to receive the housing flange.

21. The stern drive system of claim 18 wherein the housing includes a bumper receiving slot configured to receive a bumper attached to a rearward end of the housing.

22. The stern drive system of claim 18 further comprising a plurality of pliable fasteners configured to fasten the housing to the outdrive through a plurality of corresponding openings disposed at a base and a flange respectively.

23. The drive system of claim 18 further comprising a forward section of the housing having an interface edge configured to interface with the gimbal unit.

24. A kit configured to be affixed to an outdrive of a stern drive system supported by a gimbal unit and configured to rotate together with the outdrive to impart a desired trim or tilt to the drive system, the kit comprising:

a base mountable to a lower end of a tilt-trim assembly; and a housing connectable to the base to sealingly enclose components of the outdrive.

25. The kit of claim 24 wherein the housing includes a flange inwardly extending along a lower end of the housing.

26. The kit of claim 24 wherein the housing includes a bumper receiving slot configured to receive a bumper attachable to a rearward end of the housing.

27. The kit of claim 24 further comprising a plurality of fasteners configured to fasten the housing to the assembly through a plurality of corresponding openings disposed in the base and flange respectively.

28. The kit of claim 24 wherein a forward section of the housing includes an interface edge configured to interface with a gimbal housing assembly.

29. A method of shielding a tilt-trim assembly of an outdrive the method comprising the steps of:

positioning the tilt-trim assembly within a footprint of a base of an outdrive;

forming a housing to include a semi-circular configuration with an inwardly directed flange at a lower end of the semi-circular configuration; and connecting the flange of the housing to the base of the outdrive thereby enclosing the outdrive within the housing.

30. The method of claim 29 further comprising the step of connecting a forward section of the housing to a corresponding section of a gimbal housing assembly.

31. The method of claim 29 further comprising the step of sealingly enclosing the tilt trim assembly from an external environment.

32. The apparatus of claim 1 wherein the base includes a forward end, a rearward end, and a pair of sides and wherein only the rearward end and the pair of sides engage the flange of the housing.

* * * * *

UNITED STATES PATENT AND TRADEMARK OFFICE

CERTIFICATE OF CORRECTION

PATENT NO. : 6,585,545 B1
DATED : July 1, 2003
INVENTOR(S) : Neisen, Gerald F.

It is certified that error appears in the above-identified patent and that said Letters Patent is hereby corrected as shown below:

Column 2,
Line 46, delete the word "scalingly" and substitute therefore -- sealingly --;

Signed and Sealed this

Second Day of March, 2004

JON W. DUDAS
*Acting Director of the United States Patent and Trademark Office*